United States Patent [19]

Keele, Jr.

[11] 4,071,112

[45] Jan. 31, 1978

[54] HORN LOUDSPEAKER

[75] Inventor: D. Broadus Keele, Jr., Galien, Mich.

[73] Assignee: Electro-Voice, Incorporated, Buchanan, Mich.

[21] Appl. No.: 618,077

[22] Filed: Sept. 30, 1975

[51] Int. Cl.[2] ..... G10K 11/00

[52] U.S. Cl. ..... 181/187; 181/159

[58] Field of Search ..... 181/152, 159, 177–195

[56] References Cited

U.S. PATENT DOCUMENTS

| | | | |
|---|---|---|---|
| 814,891 | 3/1906 | Terhune | 181/192 |
| 1,527,505 | 2/1925 | Bartholomew | 181/180 |
| 1,693,771 | 12/1928 | Young | 181/180 X |
| 1,835,739 | 12/1931 | Abrahams | 181/193 |
| 2,203,875 | 6/1940 | Olson | 181/187 |
| 2,537,141 | 1/1951 | Klipsch | 181/187 |
| 3,930,561 | 1/1976 | Klayman | 181/192 |

*Primary Examiner*—Lawrence R. Franklin

*Attorney, Agent, or Firm*—Burmeister, York, Palmatier, Hamby & Jones

[57] ABSTRACT

A loudspeaker with a driver and horn in which the horn has a channel expanding in cross section exponentially from the throat of the horn to a second portion, the second portion expanding conically to a rapidly flaring bell portion which terminates in the mouth of the horn. In one embodiment, the channel has a rectangular cross section to provide a wider horizontal beam width than vertical beam width.

17 Claims, 7 Drawing Figures

FIG. 1
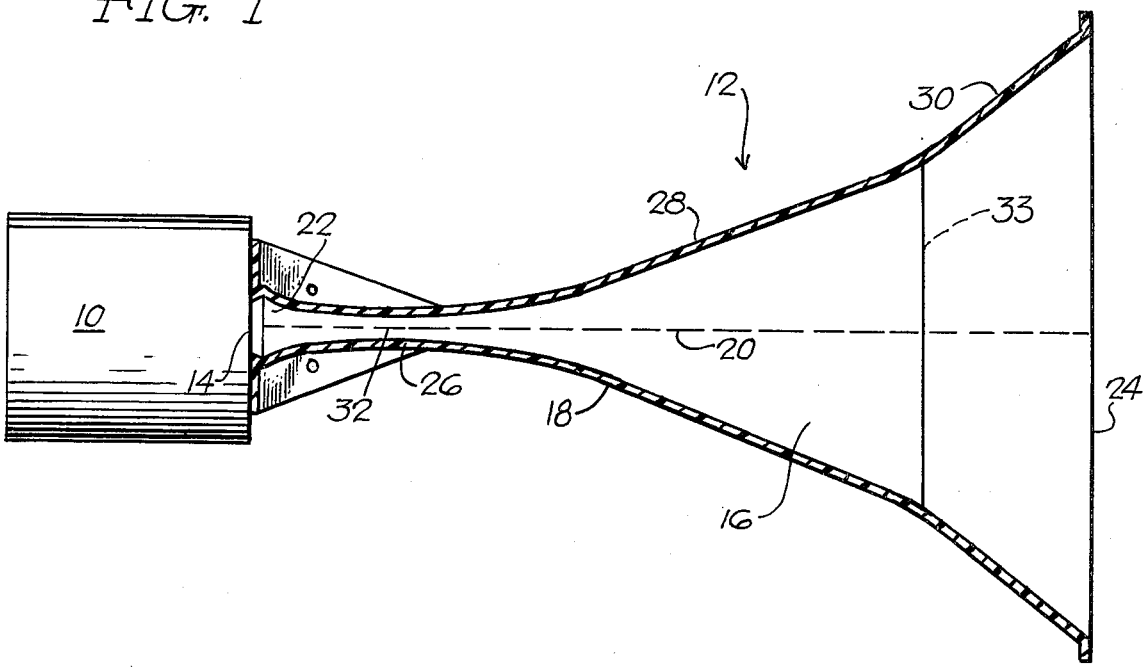
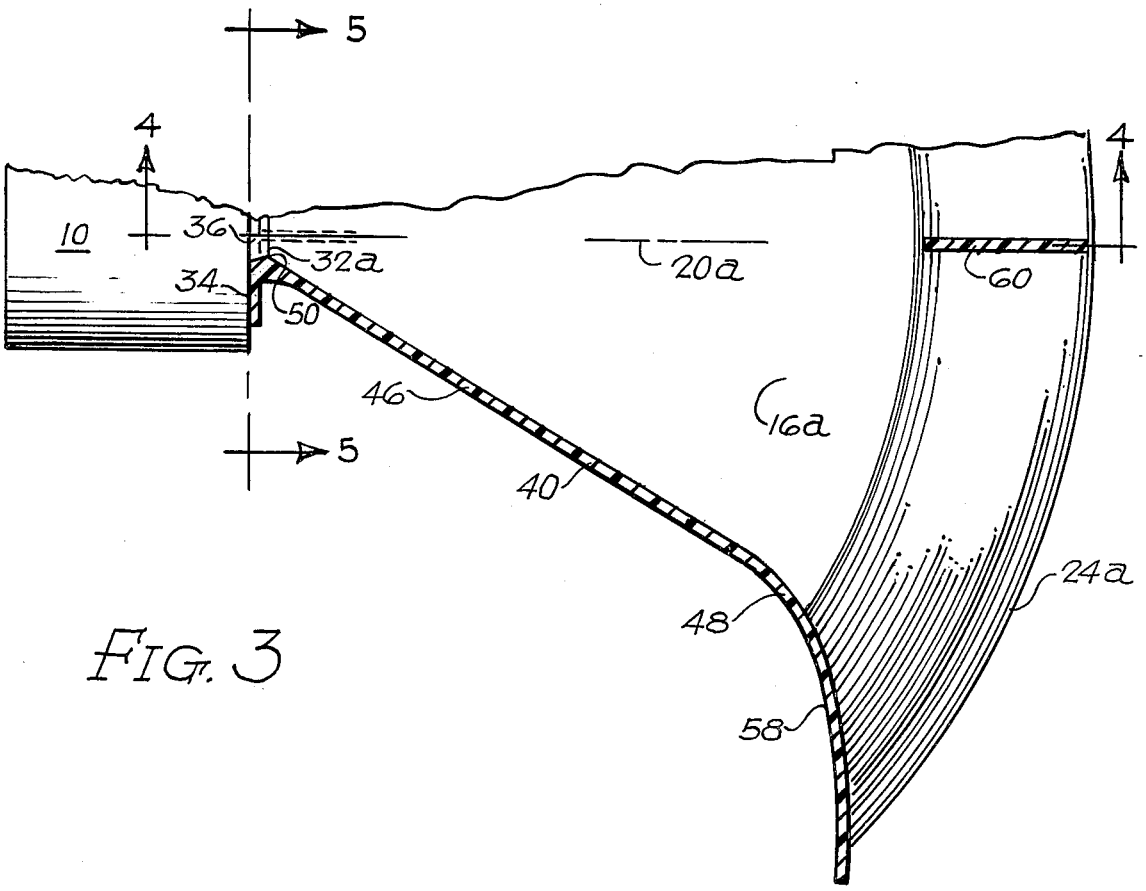
FIG. 3

FIG. 2
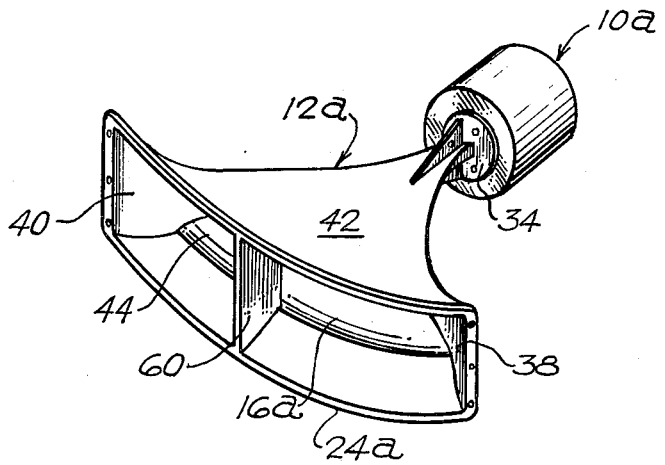
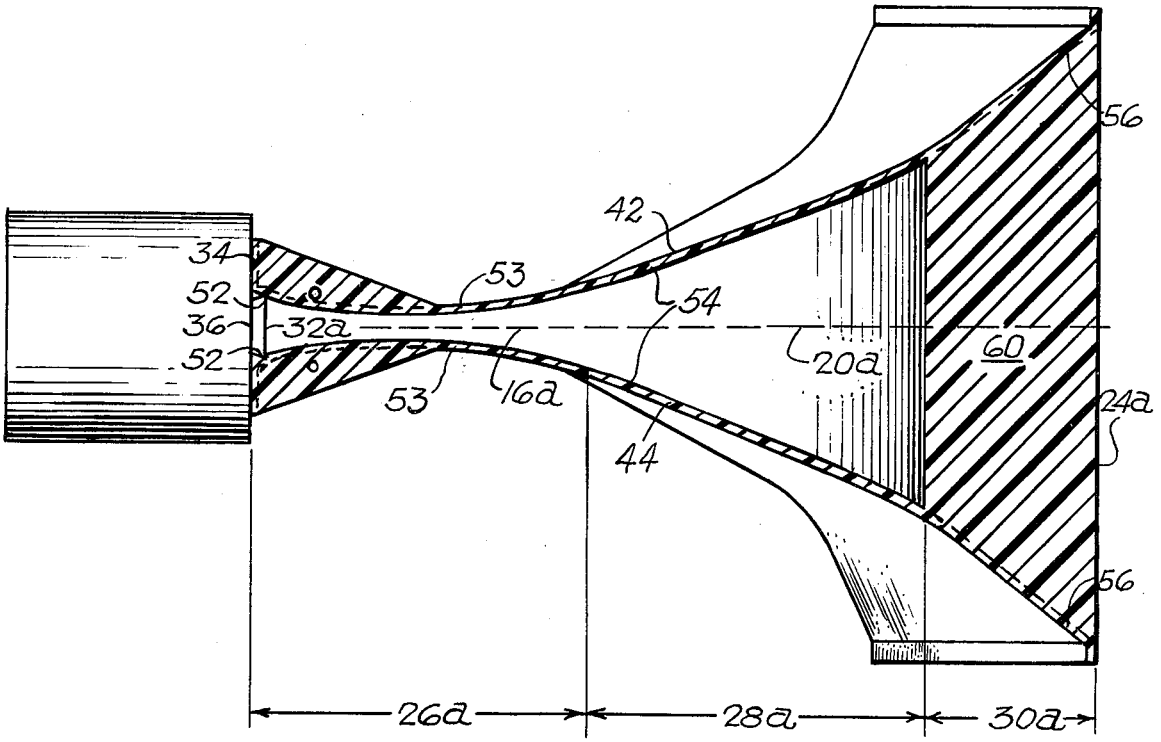
FIG. 4

HORN LOUDSPEAKER

The present invention relates to loudspeakers, particularly loudspeakers which utilize an electroacoustical driver and a horn for projecting sound generated by the electroacoustical driver.

Horns have been used to direct sound since ancient times, and an early form of the loudspeaker employed an electroacoustical driver coupled to a horn. The textbook by H. F. Olson entitled *Acoustical Engineering,* D. VanNostrand Company, Inc., Princeton, N.J., 1957, contains a detailed description on the conventional parameters used to design horns for use in such loudspeakers.

Drivers for horn type loudspeakers are generally of the dynamic type, that is, utilize a diaphragm which carries a voice coil disposed in a gap in a magnetic circuit, the diaphragm being vibratingly mounted on the elements of the magnetic circuit. In such devices electrical currents flowing through the voice coil result in motion of the diaphragm, thus imparting acoustical energy to the atmosphere confronting the diaphragm. If the diaphragm confronts open space, the air in front of the diaphragm exerts little force on the diaphragm, and the diaphragm works with very little load. This not only results in the motion of the diaphragm being controlled by its own stiffness and mass, but it also results in poor transfer of acoustical energy to the surrounding air. The energy transfer from the diaphragm to the surrounding air is greatly increased by the use of a horn which provides a confined channel to achieve the proper load on the diaphragm, and this is one of the advantages gained by utilizing a horn with an electroacoustical driver.

In order to optimize the efficiency of a horn loudspeaker, the channel of the horn is provided with a region of minimum cross sectional area measured normal to the axis of the channel at or near the driver, this region being called the throat. The horn flares outwardly from the throat to the mouth of the horn, the mouth being the opening at the end of the horn opposite the driver which communicates with the surrounding atmosphere. Various rates of expansion for the cross sectional area between the throat and the mouth of the horn have been employed in the prior art. Olson in the aforementioned textbook describes a number of flare rates including conical, exponential, and hyperbolic flare rates, and further describes a horn in which the channel of the horn has three communicating sections, all exponential and all with separate flare rates. The most widely used flare rate between the throat and the mouth of the horn is one in which the cross sectional area in a plane normal to the axis of the channel increases exponentially with distance from the throat of the horn to the mouth of the horn. An exponential horn has the advantage of projecting energy with almost equal efficiency above its cutoff frequency to the upper limit of the response range of the horn.

Horns are used in conjunction with electroacoustical drivers also for the purpose of controlling the pattern of the projected sound waves. While the exponential horn may be designed to produce efficient sound projection, its use is limited for the purpose of controlling the beam width and directivity of the projected sound. The directional characteristics of exponential horns are highly dependent upon the flare rate of the channel of the horn. The exponential multicellular horn, as described in the text of H. F. Olson referred to above, and radial/- sectoral horns such as described in U.S. Pat. No. 2,537,141 of Klipsch entitled LOUD-SPEAKER HORN, are exponential horn designs seeking to overcome the limitations in bandwidth control afforded by this type of horn. Such horn designs simulate the sound projection from a segment of a pulsating sphere, the radial air motion at the mouth of the horn having the same phase and amplitude over the spherical surface at the mouth of the horn, for sound waves having wave lengths short compared to the cross section of the mouth of the horn. Multicellular horns and radial/sectoral horns, however, exhibit a marked narrowing of the polar pattern for wavelengths approximating the cross sectional dimension of the mouth of the horn. The polar pattern may collapse to some 40 to 50% of the high frequency beam width at that frequency in which the wavelength approximates the cross sectional dimension of the horn. In addition, such horns also exhibit lobing in the polar response.

A conical horn can be expected to provide superior beam width control to an exponential horn since a conical horn because of its inherent constant solid angle configuration will simulate a segment of a radially pulsating sphere source. However, as pointed out in the text of H. F. Olson referred to above, conical horns have very poor low frequency efficiency. In addition, conical horns exhibit narrowing of the polar pattern in the mid range, similar to exponential horns.

It is an object of the present invention to provide a horn loudspeaker with improved polar response throughout a wider frequency range than prior horn loudspeakers.

It is a further object of the present invention to provide a horn loudspeaker which exhibits significantly less narrowing of the polar pattern for acoustical waves having lengths approximately equal to the cross sectional axis of the mouth of the horn.

In addition, it is an object of the present invention to provide a horn loudspeaker in which the vertical polar pattern and the horizontal polar patterns remain substantially independent of frequency over a wider range of frequency than prior horn louspeakers.

The inventor achieved the objects of the present invention by providing a loudspeaker with an electroacoustical driver and a horn with a channel extending from the driver to a mouth, the channel having a first portion which includes the throat of the horn and expands exponentially from the throat of the horn toward the mouth of the horn, and a second portion extending from the first portion and having a cross sectional area expanding proportional to the square of the distance from the first portion. Further objects of the invention are achieved by providing a rapidly expanding bell portion between the second portion of the horn and the mouth of the horn. Additional objects of the invention are achieved by providing the channel of the horn with a rectangular cross section in a plane perpendicular to the axis of the channel.

For a more detailed description of the present invention, reference is made to the drawings, in which:

FIG. 1 is a diagrammatic view of a horn loudspeaker constructed according to the teachings of the present invention;

FIG. 2 is an isometric view of a commercial construction of a horn loudspeaker constructed according to the teachings of the present invention;

FIG. 3 is a fragmentary horizontal sectional view taken along the central axis of the horn of FIG. 2, the omitted fragment being located to the right of the center line and being a mirror image of the portion of the horn shown to the left of the center line;

FIG. 4 is a vertical sectional view taken along the center line of the horn of FIG. 3;

Figure 5:
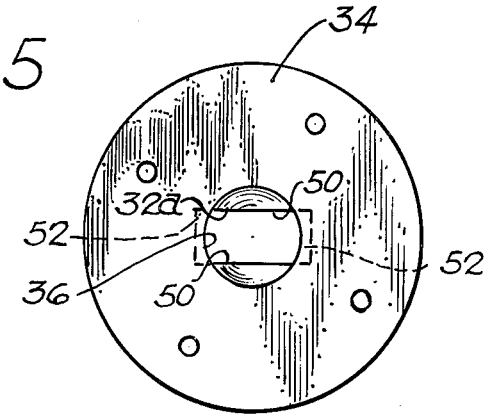
FIG. 5 is a sectional view taken along the line 5—5 of FIG. 3.
Figure 6A:
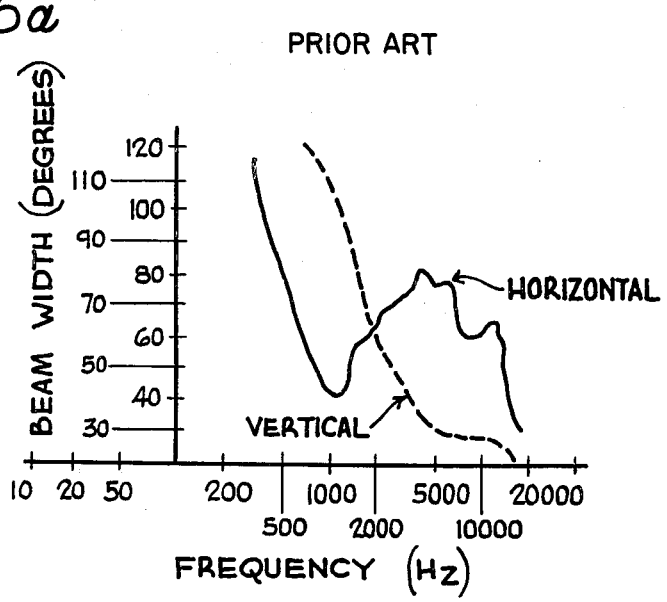
Figure 6B:
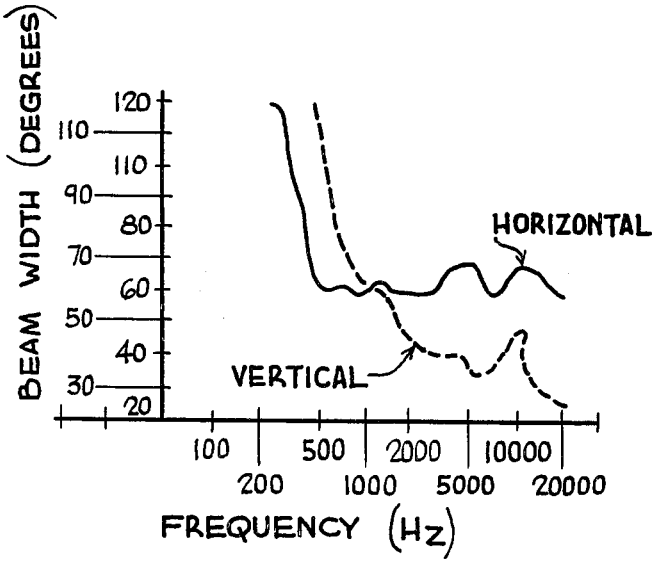

FIG. 6 consists of two graphs, graph (a) illustrating the polar response pattern of a sectoral exponential horn, and graph (b) illustrating the polar response pattern of a comparable horn constructed according to the teachings of the present invention.

Referring to FIG. 1, the loudspeaker has a driver 10 coupled to a horn 12 at an outlet port 14 of the driver. The horn 12 has an internal channel 16 formed by a wall 18. As illustrated, the channel 16 is symmetrical about a central axis 20 and has an inlet end 22 which communicates with the outlet port 14 of the driver located at one end of the channel 16, and has an open mouth 24 at the opposite end of the channel.

The channel 16 has three communicating portions extending between the inlet end 22 and the mouth 24. The first of these portions, designated 26, containing the inlet end and extending to the second portion 28. The third portion 30 is an outwardly flaring bell portion located between the second portion 28 and the mouth 24.

The minimum cross sectional area of the channel 16 measured perpendicular to the central axis 20 is located in the first portion 26 adjacent to the inlet end 22, this region being referred to in the art as the throat of the horn and being designated 32, the cross sectional area of the first portion 26 of the channel 16 between the inlet end 22 of the horn 12 and the throat 32 decreasing along the axis of the channel approaching the throat. The driver 10 is constructed in a conventional manner and contains a vibratile diaphragm which drives the column of air in the chamber between the diaphragm and the throat, and the design of this chamber and the throat promotes the efficient transfer of electrical energy supplied to the driver 10 into acoustical energy at the throat 32 of the horn 12.

In the embodiment of FIG. 1, the horn 12 has a circular cross section and is symmetrical about the central axis 20. The cross sectional area of the first portion 26 of the channel 16 measured in a plane perpendicular to the central axis 20 increases exponentially with distance from the throat 32 to the second portion 28 of the channel 16.

The second portion 28 of the channel 16 has cross sectional axes which increase linearly with distance from the first portion 26, and hence the cross sectional area measured normal to the central axis 20 increases as the square of the distance from the interface between the first portion 26 and the second portion 28. The cross sectional axes of the first portion 26 increase with incremental distance from the throat 32 at a lower rate in the region of the throat than the cross sectional axes of the second portion 28. The rate at which the cross sectional axes increase for incremental deviations in distance along the central axis 20 increases from the throat 32, and at the interface between the first portion 26 and the second portion 28 the rate at which the cross sectional axes of the first portion are increasing in length equals the rate at which the cross sectional axes of the second portion 28 increase in length throughout the entire second portion. As a result, there is a smooth transition in the wall 18 between the first portion 26 and the second portion 28 of the channel 16.

The inventor has found that a loudspeaker with a driver and a horn in which the first portion expands exponentially and the second portion expands conically will still exhibit a narrowing in the beam width of the projected sound for frequencies having wavelengths approximately equal to the diameter of the mouth of the horn. As a result of measuring sound pressure across the mouth of such a horn, the inventor has found this narrowing effect in the mid range to exist even though the sound pressure is substantially equal across the mouth of the horn. The inventor has also found that the narrowing of the beam width in the mid range of such a speaker may be materially reduced by reducing the sound pressure about the perimeter of the mouth relative to the sound pressure on the axis of the channel of the horn at the mouth. The inventor has further found that this distribution of sound pressures can be achieved by providing the channel of the horn with the third rapidly flaring portion 30 between the conical second portion 28 and the mouth 24. The concentration of sound energy about the axis of the channel at the mouth of the horn has the effect of substantially eliminating narrowing of the band width in the mid range, that is, at that frequency which has a wave length approximately equal to the diameter of the mouth normal to the axis of the channel.

Accordingly, the outwardly flaring bell portion 30 of the channel 16 has cross sectional axes increasing with distance from the second portion 28 of the channel 16 at a rate exceeding the rate at which the cross sectional axes of the second portion 28 increase with distance from the interface to the first portion 26 of the channel 16. While the rate at which the cross sectional axes of the bell portion 30 increase may be linear, exponential or some other function, the inventor has found that a linear increase produces the desired result and limits the diameter of the mouth. In a preferred construction, the bell portion 30 has a length along the axis 20 between the mouth 24 and the interface with the second portion 28 designated 33, approximately equal to one-half of the length of the second portion 28 measured along the axis 20 between the interface with the first portion 26 and the interface 33 with the bell portion 30. Further, the rate at which the cross sectional axes of the bell portion 30 increase with distance from second portion 28 in the preferred construction is twice that of the second portion 28, thereby causing the area of the cross section measured perpendicular to the central axis 20 to increase at a rate four times greater with distance from the interface with the second portion that the rate at which the cross sectional areas of the second portion measured perpendicular to the axis 20 increase with distance from the interface with the first portion 26.

FIGS. 2 through 5 show a commercial embodiment of a loudspeaker constructed according to the present invention. In FIG. 2, the driver is illustrated at 10A mounted on a horn 12A by means of a flange 34. The flange 34 has a circular opening 36 which is mounted on the driver 10A at the sound port, not shown, of the driver. The horn 12A has a pair of side walls 38 and 40 interconnected by a top wall 42 and a bottom wall 44, and the walls 38, 40, 42 and 44 form a channel 16A for the passage of sound entering through the opening 36 which corresponds to the inlet end 22 of the horn illustrated in FIG. 1.

It will be noted that the side walls 38 and 40 extend from the flange 34 in essentially flat planes perpendicular to a common plane and diverging from each other, these flat planar segments being designated 46. At the ends of the segments 46 opposite the flange 34, the side walls 38 and 40 curve outwardly from each other in a segment designated 48. The top wall 42 and bottom wall 44 are symmetrically disposed about a central plane normal to the side walls 38 and 40 and are positioned with respect to that plane to provide the various portions of the channel 16A.

A rectangular throat 32A is provided in the channel 16A inwardly and adjacent to the flange 34. The channel 16A tapers inwardly from the opening 36 to straight edges 50 formed by the walls 38 and 40, and the top wall 42 and bottom wall 44 extend outwardly to form straight edges 52, the edges 50 and 52 forming the rectangular throat 32A. Sound energy from the driver 10A passes through the opening 36 to the throat 32A and emanates from the plane of the throat 32A at approximately equal amplitude and phase throughout the entire plane.

The channel 16A is open at the end opposite the throat 32A, thus forming the mouth 24A of the horn. As in the previous embodiment, the horn 12A has three portions designated 26A, 28A and 30A, the throat 32A being in the first portion 26A. FIG. 4 illustrates the location of each of the portions 26A, 28A and 30A. It will be noted that the walls 42 and 44 converge toward the central axis 20A of the horn from the throat 32A for a short distance, while the walls 38 and 40 diverge from the throat. As a result the area of the channel measured in planes perpendicular to the central axis 20A expands slowly in the region immediately adjacent to the throat 32A. In the first portion 26A of the channel 16A, the cross sectional area of the channel measured in planes perpendicular to the central axis 20A increase with distance from the throat 32A as an exponential function, this portion of the channel 16A being exponential. Accordingly, the portion of the top wall 42 and bottom wall 44 in this region, designated 53, curve generally outwardly to the interface with the portion 28A.

The second portion 28A is characterized by flat wall segments 54 in the top wall 42 and bottom wall 44 as well as the flat planar segments 46 of the side walls 38 and 40. Accordingly, the cross sectional area measured normal to the central axis 20A in the second portion 28A of the channel 16A increases as the square of the distance from the interface with the first portion 26A of the channel 16A. Accordingly, the second portion 28A of the channel 16A expands conically from the interface with the first portion 26A.

The bell portion 30A of the channel 16A is formed by substantially flat segments 56 of the top wall 42 and bottom wall 44 which extend from the flat segments 54 to the mouth 24A of the channel 16A, the flat segments 56 being at a greater angle with respect to the central axis 20A than the segments 54. In addition, the side walls 38 and 40 are provided with curved segments 58 extending from the flat planar segments 46 to the mouth 24A of the channel 16A. Accordingly, the cross sectional area measured normal to the central axis 20A increases in the bell portion of the channel 16A as the square of the distance from the interface with the second portion 28A of the channel 16A.

A flat vane 60 extends between the top wall 42 and bottom wall 44 on the center line 20A of the channel 16A, the vane 60 being mounted on the top wall 42 and bottom wall 44 centrally of the mouth 24A. The vane 60 provides structural rigidity to the horn.

FIG. 6(*a*) illustrates the beam width propagated by a commercial exponential horn having a purported horizontal beam width of 60° and vertical beam width of 40°, the vertical axis of the graph being calibrated in degrees of bandwidth and the horizontal axis of the graph being calibrated in frequency. It will be noted that in the region of 1000 Hz., the horizontal beam width collapses to well below the rated 60° beam width. FIG. 6(*b*) illustrates the same data for a loudspeaker with a driver and horn constructed according to the present invention and with corresponding dimensions to the horn whose data is recorded in FIG. 6(*a*). It will be noted that the collapse in beam width in the mid range of the horizontal projection of the loudspeaker in FIG. 6(*b*) is absent, and the beam width in the horizontal plane from approximately 500 Hz. to approaching 20,000 Hz. is substantially improved.

By constructing the horn of the present invention with a much broader horizontal angle (60° for example) than vertical angle (30° for example) unnecessary vertical sound projection is avoided. Nonetheless, the data for the vertical beam width of a conventional exponential horn set forth in FIG. 6(*a*) collapses at a much lower frequency and is less uniform than that achieved by a corresponding horn constructed according to the teachings of the present invention as set forth in FIG. 6(*b*).

The present invention may be utilized with horn loudspeakers with very broad beam widths, such as 100°, or very narrow beam widths, such as 30°, and will result in more uniform distribution of sound within the beam width throughout the frequency range of the loudspeaker. It is intended that the present invention be not limited by the specific specification set forth herein, but rather only by the appended claims.

The invention claimed is:

1. A loudspeaker comprising a driver for generating sound waves over a range of frequencies having a sound outlet port, and a horn having a channel extending therethrough from an inlet end to a mouth, said horn being mounted on the driver with the inlet end of the channel acoustically sealed on the port of the driver, the channel having a first portion extending from the driver and a second portion extending from the first portion, the first portion of the channel having a throat of minimum cross section adjacent to the port of the driver, the second portion of the channel of the horn having cross sectional areas increasing as the square of the distance from the first portion of the channel, said first and second portions of the channel having substantially the same cross sectional area at the interface of said first and second portions, and the cross sectional area of the first portion of the channel increasing with distance from the throat of the channel at a rate of increase increasing with distance from the throat of the channel from a rate less than the rate of increase of the second portion of the channel at the interface between the first and second portions of the channel.

2. A loudspeaker comprising the combination of claim 1 in combination with means associated with the second portion of the channel of the horn for increasing the amplitude of sound waves about the center of the mouth of the channel relative to sound waves at the walls of the channel at the mouth for sound waves having wavelengths in a band including the wavelength equal to the cross sectional axis of the mouth.

3. A loudspeaker comprising the combination of claim 2 wherein the means for increasing the amplitude of sound waves about the center of the mouth of the channel relative to sound waves at the wall of the channel at said mouth for sound waves having a wavelength in a band including the wavelength equal to the cross sectional axis of the mouth of the channel comprises an outwardly flaring bell portion of the channel disposed between the second portion of the channel and the mouth, the cross sectional area of the channel in the bell portion increasing with distance from the second portion of the channel at a greater rate than the cross sectional area of the second portion of the channel of the horn increases with distance from the first portion of the channel of the horn.

4. A loudspeaker comprising the combination of claim 3 wherein the cross sectional area of the bell portion of the channel increases with distance from the second portion of the channel at a rate approximately four times the rate of increase of the cross sectional area of the second portion of the channel with distance from the first portion of the channel.

5. A loudspeaker comprising the combination of claim 3 wherein the length of the portion of the channel disposed in the bell portion thereof measured along its central axis is approximately one-half of the length of the portion of the channel disposed in the second portion thereof measured along its central axis.

6. A loudspeaker comprising the combination of claim 5 wherein the channel has a rectangular cross section and a flat vane extends across the channel on the central axis thereof between the longer walls of the horn at the mouth thereof.

7. A loudspeaker comprising the combination of claim 1 wherein the cross sectional area of the first portion of the channel increases with distance from the throat according to an exponential function.

8. A loudspeaker comprising the combination of claim 1 wherein the channel is provided with a rectangular cross section.

9. A loudspeaker comprising the combination of claim 1 wherein the rate of increase in cross sectional area of the first portion of the channel with distance from the throat at the interface of the second portion of the channel equals the rate of increase in cross sectional area of the second portion of the channel with distance from the first portion of the channel.

10. A horn for use with a driver generating sound waves over a range of frequencies having a sound outlet port comprising means defining a channel extending therethrough from an inlet end to a mouth, said horn being adapted to be mounted on the driver with the inlet end of the channel acoustically sealed on the port of the driver, the channel having a first portion extending from the inlet end and a second portion extending from the first portion, the cross sectional area of the second portion of the channel increasing as the square of the distance from the first portion of the channel, said first and second portions of the channel having substantially the same cross sectional area at the interface of said first and second portions, the first portion of the channel having a throat of minimum cross section adjacent to the inlet end, and the cross sectional area of the first portion of the channel increasing exponentially with distance from the throat of the channel.

11. A horn comprising the combination of claim 1 in combination with means associated with the second portion of the channel of the horn for increasing the amplitude of sound waves about the center of the mouth of the channel relative to sound waves at the walls of the channel at the mouth for sound waves having wavelengths in a band including the wavelength equal to the cross sectional axis of the mouth.

12. A horn comprising the combination of claim 11 wherein the means for increasing the amplitude of sound waves about the center of the mouth of the channel relative to sound waves at the wall of the channel at said mouth for sound waves having a wavelength in a band including the wavelength equal to the cross sectional axis of the mouth of the channel comprises an outwardly flaring bell portion of the channel disposed between the second portion of the channel and the mouth, the cross sectional area of the channel in the bell portion increasing with distance from the second portion of the channel at a greater rate than the cross sectional area of the second portion of the channel of the horn increases with distance from the first portion of the channel of the horn.

13. A horn comprising the combination of claim 12 wherein the cross sectional area of the bell portion of the channel increases with distance from the second portion of the channel at a rate approximately four times the rate of increase of the cross sectional area of the second portion of the channel with distance from the first portion of the channel.

14. A horn comprising the combination of claim 12 wherein the length of the portion of the channel disposed in the bell portion thereof measured along its central axis is approximately one-half of the length of the portion of the channel disposed in the second portion thereof measured along its central axis.

15. A horn comprising the combination of claim 14 wherein the channel has a rectangular cross section and a flat vane extends across the channel on the central axis thereof between the longer walls of the horn at the mouth thereof.

16. A horn comprising the combination of claim 10 wherein the rate of increase in cross sectional area of the first portion of the channel with distance from the throat at the interface of the second portion of the channel equals the rate of increase in cross sectional area of the second portion of the channel with the distance from the first portion of the channel.

17. A horn comprising the combination of claim 10 wherein the channel is provided with a rectangular cross section.

* * * * *

UNITED STATES PATENT OFFICE

CERTIFICATE OF CORRECTION

Patent No. 4,071,112 Dated January 31, 1978

Inventor(s) D. Broadus, Keele, Jr.

It is certified that error appears in the above-identified patent and that said Letters Patent are hereby corrected as shown below:

Column 2, Line 42

Delete "louspeakers" and insert --loudspeakers--

Column 4, Line 53

After "portion" delete "that" and insert --than--

Column 8, Line 7

After"claim" delete "1" and insert --10--

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*